United States Patent [19]

Wakeman et al.

[11] Patent Number: 4,796,573

[45] Date of Patent: Jan. 10, 1989

[54] HYDRAULIC ENGINE VALVE LIFTER ASSEMBLY

[75] Inventors: Russell J. Wakeman; Stephen F. Shea, both of Newport News, Va.

[73] Assignee: Allied-Signal Inc., Morris County, Morris Township, N.J.

[21] Appl. No.: 103,879

[22] Filed: Oct. 2, 1987

[51] Int. Cl.[4] ..... F01L 1/24

[52] U.S. Cl. ..... 123/90.16; 123/90.56

[58] Field of Search ..... 123/90.12, 90.16, 90.43, 123/90.46, 90.55, 90.56, 90.57, 90.59

[56] References Cited

U.S. PATENT DOCUMENTS

| | | | |
|---|---|---|---|
| 3,650,251 | 3/1972 | Pelizzoni | 123/90.57 |
| 3,921,609 | 11/1975 | Rhoads | 123/90.55 |
| 4,134,371 | 1/1979 | Hausknecht | 123/90.43 |
| 4,218,995 | 8/1980 | Aoyama | 123/90.16 X |
| 4,258,671 | 3/1981 | Takizawa et al. | 123/90.16 |
| 4,285,310 | 8/1981 | Takizawa et al. | 123/90.16 X |
| 4,347,812 | 9/1982 | Kosuda et al. | 123/90.55 |
| 4,452,186 | 6/1984 | List et al. | 123/90.16 |
| 4,452,187 | 6/1984 | Kosuda et al. | 123/90.16 |
| 4,466,390 | 8/1984 | Babitzka et al. | 123/90.16 |
| 4,524,731 | 6/1985 | Rhoads | 123/90.57 |
| 4,615,306 | 10/1986 | Wakeman | 123/90.16 |
| 4,671,221 | 6/1987 | Geringer et al. | 123/90.16 |
| 4,674,451 | 6/1987 | Rembold et al. | 123/90.16 |
| 4,696,265 | 9/1987 | Nohira | 123/90.16 |

FOREIGN PATENT DOCUMENTS

| | | | |
|---|---|---|---|
| 0196441 | 10/1986 | European Pat. Off. . | |
| 0153810 | 12/1980 | Japan | 123/90.16 |

*Primary Examiner*—Willis R. Wolfe

*Attorney, Agent, or Firm*—Nixon & Vanderhye

[57] ABSTRACT

Hydraulic engine valve lifter includes a pair of pistons defining a pressure chamber therebetween and a separate lash adjusting piston which defines a lash adjustment chamber with one of the pistons in the pair. One-way valve structures permit fluid to flow from the pressure chamber into the lash adjustment chamber thereby displacing the lash adjusting piston to, in turn, adjust valve lash. Motion damping functions during a downstroke of the lifter pistons are also provided by a valve damper chamber and fluid passageways between the pressure and damper chambers. Structure is provided which opens communication between the pressure and damper chambers during upstroke of the lifter pistons (thereby precluding motion damping) and then closes communication at a predetermined location during downstroke (thereby providing motion damping).

39 Claims, 7 Drawing Sheets

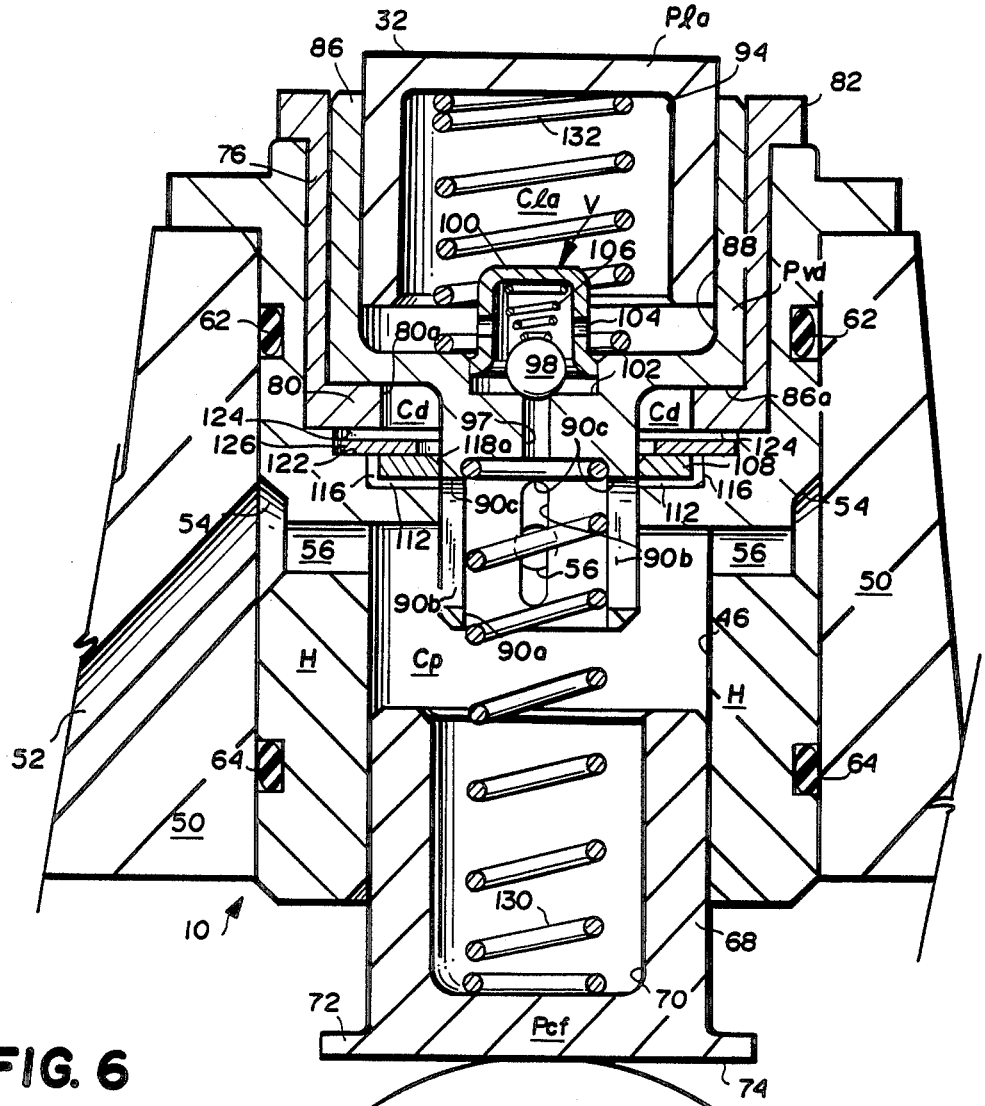
FIG. 6
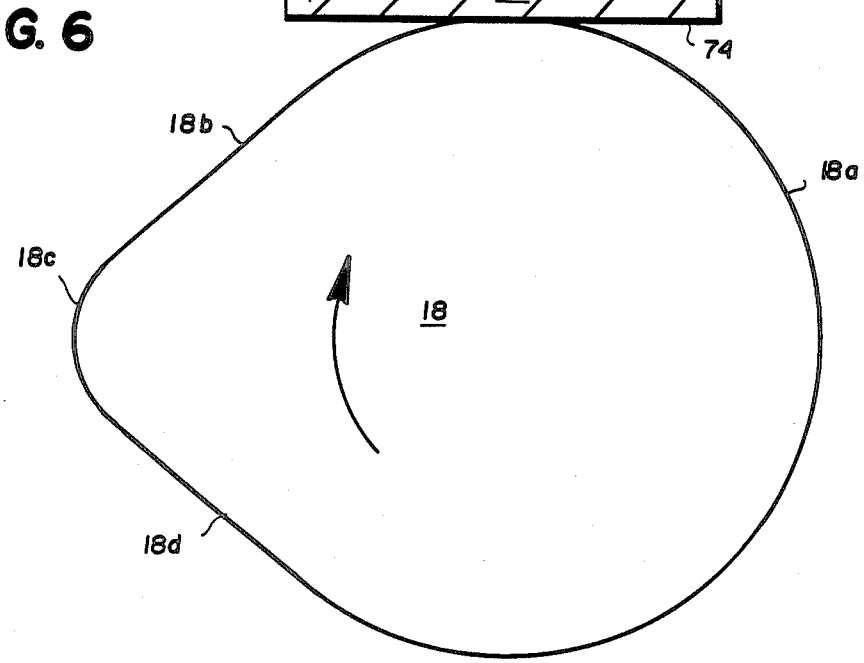

HYDRAULIC ENGINE VALVE LIFTER ASSEMBLY

FIELD OF THE INVENTION

This invention generally relates to the field of internal combustion engines, and more particularly, to engines utilizing hydraulic engine valve lifters. In one form, the invention includes an especially adapted hydraulic engine valve lifter assembly having valve damping and/or valve lash adjusting functions as well as an internal combustion engine which employs such an especially adapted valve lifter assembly. In a specific embodiment, the hydraulic valve lifter of this invention is provided with a pair of pistons which define a pressure chamber therebetween and a separate valve lash adjusting piston which defines a lash adjustment chamber with respect to one of the pistons in the pair. One-way valve means permit fluid to flow into the valve lash adjustment chamber from the pressure chamber to thereby hydraulically displace the separate valve lash adjusting piston independently of the piston pair to thus adjust valve lash. Valve damping functions are provided by a valve damping chamber and valving structures which allow motion damping to occur only during a downstroke of the lifter pistons.

BACKGROUND AND SUMMARY OF THE INVENTION

Hydraulic valve lifters have been utilized for some time so as to vary timing and duration of valve opening so as to provide more optimum engine performance at various operating conditions (i.e. so-called "lost motion" systems). One such system employing hydraulic valve lifters is disclosed in U.S. Pat. No. 4,615,306 entitled "Engine Valve Timing Control System" of Russell J. Wakeman, issued Oct. 7, 1986 (the entire contents of this prior patent being expressly incorporated hereinto by reference and referred to hereinbelow as "the Wakeman '306 patent"). In the Wakeman '306 patent, valve timing and valve opening duration are controlled via pressure pulses developed within the engine oil supply as a result of lifter operation. The valve lifters themselves include a collapsible hydraulic link controlled by a solenoid. In a particular embodiment (see FIG. 6 of the Wakeman '306 patent), a pair of pistons defines therebetween a chamber which communicates with the solenoid. As the lower piston is being moved up the cam's profile, oil is pushed out of the lifter into bleed passageways until the lower piston's displacement is to be transferred hydraulically to the upper piston as dictated by an electronic control unit (ECU), at which time the solenoid is energized thereby forming a solid hydraulic link coupling the motion of the lower piston to the upper piston which, in turn, actuates valve opening. Since the effect of such a system is to eliminate the gentle closing ramp associated with the cam, high valve closing velocities and associated noise and valve durability problems (i.e., excessive valve wear) may result. Hence, it would be desirable to damp the valve closure during final travel to its seat.

Valve damping functions for hydraulic valve lifters have been proposed in U.S. Pat. No. 4,452,187 entitled "Hydraulic Valve Lift Device" of Toru Kosuda et al, issued June 5, 1984; U.S. Pat. No. 4,347,812 entitled "Hydraulic Valve Lift Device" of Toru Kosuda et al, issued Sept. 7, 1982; and U.S. Pat. No. 4,671,221 entitled "Valve Control Arrangement" of Bernhard Geringer et al, issued June 9, 1987.

In Kosuda et al '187 and '812 a so-called braking chamber is disclosed as being annular with respect to a plunger, the latter having a slit which allows oil to flow thereinto from an oil feed chamber during an upstroke of the plunger. Upon a downstroke of the plunger, the oil in the braking chamber will thus flow into the oil feed chamber through the slit and oil feed ports thereby reducing the volume of the braking chamber. As the plunger is further lowered during its downstroke so as to render the oil feed ports completely closed, the slit will commence to restrict the flow of oil from the braking chamber to the oil feed chamber (due to a variable open area of the slit being presented during its movement) and, as a result, the pressure in the braking chamber increases so as to act against the further lowering of the plunger thereby braking downward motion of the same.

Geringer et al '221 proposes to brake the motion of the valve on closing by providing a ramp-shaped annular chamber which cooperates with a ring-shaped projection of the housing block so that when the valve piston is in its downstroke, the ramp-shaped chamber is increasingly closed by means of a gap between the projection and the ramps defining the chamber. The chamber thus narrows with increasing overlapping of the ramps and the face of the ring-shaped projection.

While Kosuda et al '187 and '812 and Geringer et al '221 provide valve braking or damping functions, hydraulic valve lash adjustment independent of the hydraulic link established between the pair of working pistons is unavailable. Geringer et al '221, in any event, cannot provide for hydraulic valve lash adjustment since a rigid mechanical connection exists between one of the working pistons in the Geringer et al '221 system and its associated engine valve. Kosuda et al '187 and '812, on the other hand, while having hydraulic valve lash adjusting capabilities, accomplish such valve lash adjustment in dependance upon pressurized oil in the lifter's pressure chamber—that is, in dependance upon the hydraulic link established between the pair of working pistons. What has been needed therefore is an improved hydraulic valve lifter which not only damps valve motion during its final travel (and thereby alleviates some of the problems associated with "lost motion" valve lifting systems) but which also adjusts valve lash hydraulically independent of the hydraulic link established between working pistons of the valve lifter. It is towards attaining such improvements that the present invention is directed.

In accordance with the present invention, a hydraulic valve lifter assembly is disclosed and claimed whereby valve damping and/or valve lash adjusting functions may be provided. And, the valve lash adjusting functions are achieved hydraulically independent of the hydraulic link established between its pair of working pistons. Those functions are provided (at least in part) by a lash adjusting piston and associated lash adjustment chamber whereby fluid may flow into same from a pressure chamber defined between a cam follower piston and a valve damping piston via an aperture in the latter. Thus, hydraulic displacement of the lash adjustment piston and concomitant adjusting of the valve lash occurs.

The lash adjusting piston, in a particularly preferred embodiment of the invention, is slidably received within a cylindrical cavity of an axially elongate flange of the valve damping piston so as to define therebetween the lash adjusting chamber in which a compression spring is disposed, the spring biasing the valve damping and lash adjustment pistons in a direction tending to separate the same. Moreover, one-way valve structure (e.g. a spherical plug) normally closes the aperture defined in the valve damping piston. Since the cam follower piston preferably defines a cam follower surface having a greater surface area as compared to the upper surface of the lash adjusting piston (which is adapted to cooperate with motion-transferring structures to open/close the engine valve), the force transferred to the cam follower piston at positions on the cam other than the cam's base circle is believed to be translated into a lesser pressure within the pressure chamber as compared to the pressure within the lash adjustment chamber. Thus, a solid hydraulic link is established between the cam follower piston on the one hand and the valve damping/lash adjusting pistons on the other hand during upstrokes and downstrokes of the latter. However, with the cam follower surface in contact with the base circle (and hence substantially equivalent pressures in the pressure and lash adjustment chambers), the bias force of the spring will urge the lash adjustment piston into zero lash relationship with the motion-transferring structure (e.g. rocker arm, push rod, etc.) and thereby unseat the one-way valve structure to open the aperture and allow for an additional amount of oil to flow from the pressure chamber into the lash adjusting chamber. In this way, valve lash is hydraulically adjusted independent of the hydraulic link between the cam follower and valve damping/lash adjusting pistons.

Primary and secondary fluid passageways establish fluid communication between the pressure and damper chambers and are closed via respective primary and secondary passageway-closing structures. In order to prevent motion damping from occurring during lifter upstroke, fluid is initially allowed to flow from the pressure chamber to the damper chamber via the secondary passageway when the valve damping and cam follower pistons first being an upstroke from their rest positions. Later in the upstroke, fluid flows into the damper chamber via both primary and secondary passageways. During a downstroke of the follower and valve damping pistons, the secondary passageway is closed and thus fluid flows from the damper chamber to the pressure chamber only via the primary passageway. Such fluid flow continues until the valve damping piston reaches a predetermined position during its downstroke (established when the primary passageway-closing structure closes the primary fluid passageway). The fluid remaining in the damper chamber thus damps further movement of the valve damping piston from its predetermined position to its rest position.

The improvements and advantages of this invention briefly mentioned above will become more clear after careful consideration is given to the detailed description thereof which follows.

BRIEF DESCRIPTION OF THE DRAWINGS

Reference will hereinafter be made to the accompanying drawings wherein like reference numerals throughout the various Figures denote like structural elements, and wherein;

FIG. 6 is a cross-sectional elevational view of the lifter assembly of this invention shown in its rest or downstroke position;

DETAILED DESCRIPTION OF THE INVENTION

Figure 1:
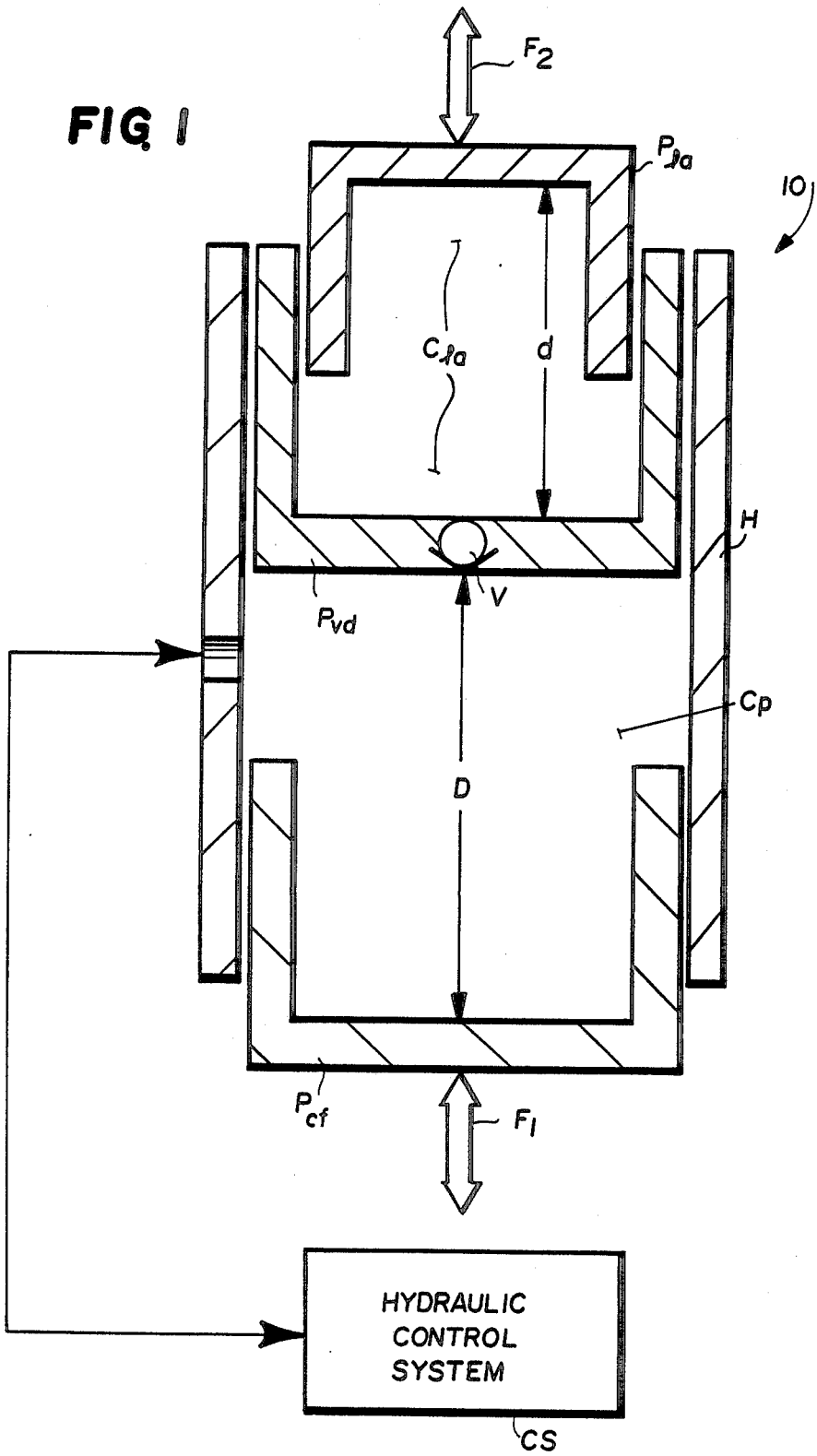
FIG. 1 is a schematic view of a lifter assembly of this invention is associated with a hydraulic control system.

Referring to the accompanying drawings, FIG. 1 schematically depicts a valve control system employing a hydraulic lifter assembly 10 of this invention. As is seen, the assembly 10 includes a housing H and a pair of pistons (hereinafter referred to as cam follower piston $P_{cf}$ and valve damping piston $P_{vd}$) which define a pressure chamber $C_p$ therebetween. A separate lash adjusting piston $P_{la}$ is coaxially positioned relative to pistons $P_{cf}$ and $P_{vd}$ and defines a lash adjustment chamber $C_{la}$ with the latter.

Fluid (i.e. oil) is introduced into and discharged from chamber $C_p$ as dictated by the hydraulic control system CS. Preferably, control system CS is in accordance with that described in the Wakeman '306 patent and thus establishes a solid hydraulic link between piston $P_{cf}$ and $P_{vd}$ via oil in chamber $C_p$. Another solid hydraulic link between pistons $P_{vd}$ and $P_{la}$ is established according to this invention due to oil entering lash adjustment chamber $C_{la}$ via one-way valve V.

Reciprocal displacements of piston $P_{cf}$ (arrow $F_1$) due to, for example, force applied by a rotating cam is transmitted via these two hydraulic links into reciprocal displacements of pistons $P_{vd}$ and $P_{la}$ (arrow $F_2$) so as to responsively open and close an engine valve. That is, when the solid hydraulic links are established by control system CS, distances "D" between pistons $P_{cf}$ and $P_{vd}$ and "d" between pistons $P_{vd}$ and $P_{la}$ remain substantially constant. One-way valve V is such that it remains closed during such reciprocal displacements (as will be discussed in greater detail below), however, when lash is to be adjusted (i.e. so as to maintain zero lash between piston $P_{la}$ and that structure which transfers motion to the engine valve), one-way valve V allows oil to flow into chamber $C_{la}$ from chamber $C_p$ thereby displacing piston $P_{la}$ relative ot piston $P_{vd}$ and thus increase dimension "d" so as to adjust valve lash. It should be noted that some oil leakage occurs as between the various pistons $P_{cf}$, $P_{vd}$ and $P_{la}$ but any such oil loss from chambers $C_p$ and $C_{la}$ is compensated for during the next cycle of the lifter assembly 10.

Figure 2:
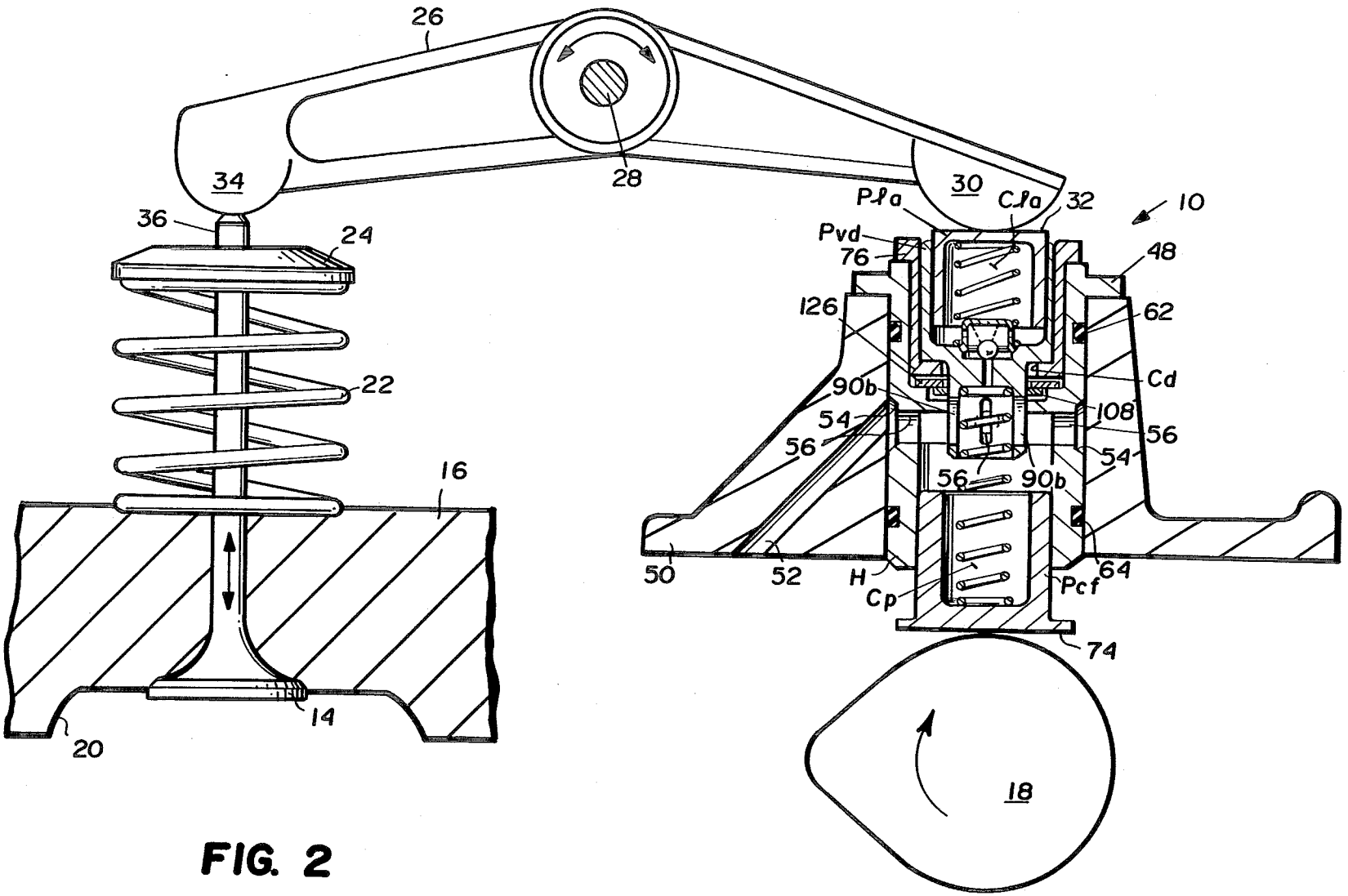
FIG. 2 is a schematic elevational view, partially in cross-section, showing the lifter assembly of this invention in operative association with an engine valve.

In FIG. 2, the hydraulic lifter assembly 10 of this invention is shown schematically in cross-sectional elevational view with its associated engine valve 14. (Although only a single lifter assembly 10 and its associated engine valve 14 are shown in FIG. 2, it is, of course, to be understood that in an internal combustion engine, sets of lifter assemblies/engine valves 10/14 will be employed for each cylinder of the engine.)

As is conventional, the engine valve 14 is slidably received within the valve block 16 for reciprocal movements between open and closed positions dictated by the profile of rotating cam 18. The opening and closing of valve 14 thus introduces a fuel/air mixture into combustion chamber 20 (if valve 14 is an intake valve in an internal combustion engine, for example) or permits exhaust gases to be exhausted through an exhaust port (not shown) from chamber 20 (if valve 14 is an exhaust valve in an internal combustion engine, for example). Valve 14 is retained in position by a compression spring 22 and spring cap 24, the spring 22 biasing valve 14 into its closed or seated position as shown in FIG. 2.

A rocker arm 26 is mounted for pivotal movements about its fulcrum 28 and includes one end 30 in contact with an upper surface 32 of lifter assembly 10 and another end 34 in contact with the upper portion of valve stem 36. Thus, displacements of upper surface 32 of lifter assembly 10 (in a manner which will be described in greater detail below), will cause valve 14 to be moved between its opened and closed positions via the motion transfer provided by the pivotal action of rocker arm 26.

The above-described operation to open and close valve 14 is highly conventional in this art (except for the provision of lifter assembly 10) and thus need not be described in further detail here. Suffice it to say, however, that although FIG. 2 depicts a rocker arm type engine so as to transfer motion between the lifter assembly 10 and the valve 14, the lifter assembly 10 of this invention may be suitably employed in engines having other valve lifter motion-transferring structures—for example, engines employing push rods or finger followers—in addition to direct acting overhead cam type engines, to name a few.

Figure 3:
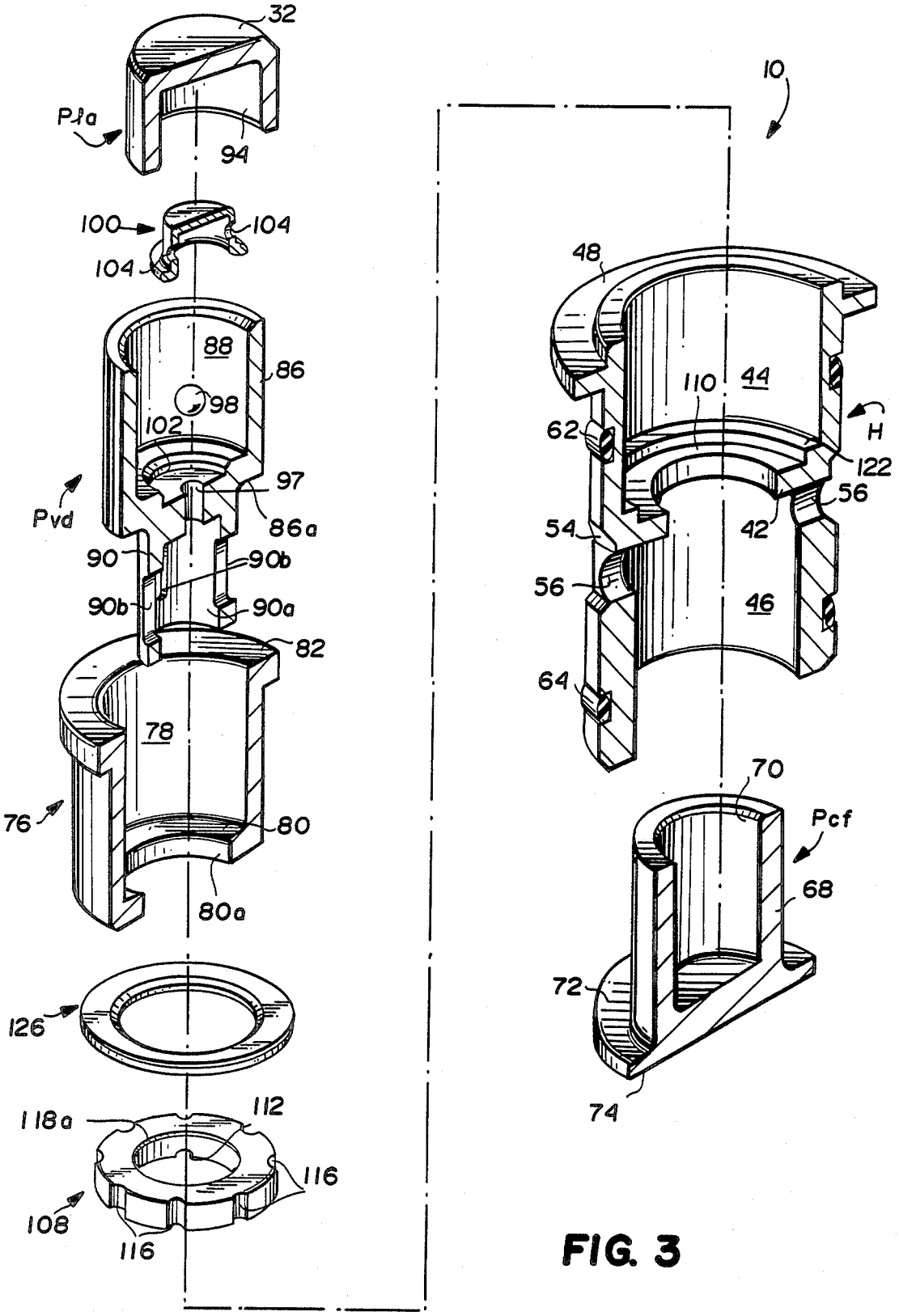
FIG. 3 is an exploded cross-sectional elevational view of the lifter assembly of this invention.

Accompanying FIG. 3 shows in greater detail the major component parts of the lifter assembly 10 in accordance with this invention. As is seen, the housing H is provided with an interior annular shoulder 42 which subdivides the interior of housing H into upper and lower generally cylindrical sub-bores 44, 46, respectively.

Housing H further includes an upper flange 48 adapted to seat against lifter block 50 (see FIG. 2) when lifter assembly 10 is mounted therein. Lifter block 50 is provided with an oil port 52 communicating with an annular oil supply channel 54 defined on an exterior circumferential region of housing H. Housing H is also provided with entrance/exit ports 56 communicating with channel 54 to permit oil to enter/exit lower sub-bore 46. Oil which exits sub-bore 46 via entrance/exit ports 56 is removed from the vicinity of lifter assembly 10 by oil port 52 and, conversely, oil entering sub-bore 46 via entrance/exit ports 56 is supplied thereto via oil port 52. The oil circuitry to and from the entrance/exit ports 56 via oil port 52 is dictated by the hydraulic control system CS (see FIG. 1). Conventional O-ring seals 62, 64 are provided in respective upper and lower exterior circumferential regions of housing H so as to seal housing H/lifter block 60 against oil leakages.

Slidably received within lower sub-bore 46 is the cam follower piston $P_{cf}$ which includes a stem 68 defining an open-ended generally cylindrical interior cavity 70. The stem 68 terminates in a flange 72—the latter defining a planar cam follower surface 74. The cam follower surface 74 thus follows the profile of the cam 18 during rotation of the latter so as to, in turn, cause piston $P_{cf}$ to be reciprocally slidably displaced within sub-bore 46 of housing H. The open-ended cylindrical cavity 70 of cam follower piston $P_{cf}$ establishes, together with the lower sub-bore 46 of housing H, the pressure chamber $C_p$ (see FIG. 2) into which oil is admitted and discharged via entrance/exit ports 56.

A retaining sleeve 76 defines a cylindrical cavity 78 and is immovably press-fitted into upper sub-bore 44 of housing H. Retaining sleeve 76 includes an inwardly turned lower retaining flange 80 and an upper flange 82, the latter of which seats against the upper end of housing H when sleeve 76 is positioned within sub-bore 44.

Valve damping piston $P_{vd}$ is provided with an axially elongate upper flange 86 defining an interior cylindrical cavity 88 and a lower axially depending stem 90. Axial flange 86 of valve damping piston $P_{vd}$ is slidably received within cavity 78 of retaining sleeve 76 such that, when piston $P_{vd}$ is in a seated position, annular shoulder surface **86*a* bears against lower flange 80 of retaining member 76. Stem portion 90 of valve damping piston $P_{vd}$ thus extends through the space defined by face 80*a* of flange 80 into lower sub-bore 46 (i.e. into pressure chamber $C_p$). Stem 90 itself defines an interior cylindrical cavity 90*a* and plural axially elongate slots 90*b*, each of which communicate with pressure chamber $C_p$ and interior cavity 90*a*. In practice, it is preferred that four slots 90*b* are provided in equally spaced relationship about the periphery of step 90**.

Figure 5:
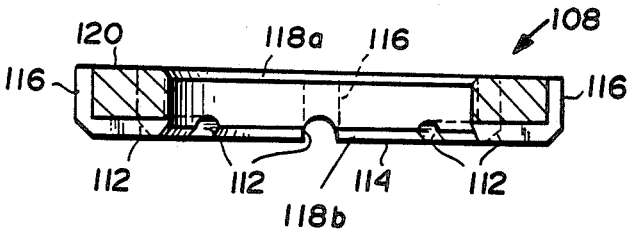
FIG. 5 is a cross-sectional view of the fluid bypass ring shown in FIG. 3 taken along line 4—4 therein.

The lash adjusting piston $P_{la}$ defines an interior cylindrical cavity 94 and the previously mentioned exterior upper surface 32. The interior cavity 94 of lash adjusting piston $P_{la}$ and the cavity 88 of valve damping piston $P_{vd}$ together establish the valve lash adjustment chamber $C_{la}$ (see FIGS. 2 and 6–8) into which oil may be admitted from pressure chamber $C_p$ via coaxial aperture 97 defined by valve damping piston $P_{vd}$. Aperture 97 is normally closed via any suitable one-way valve structure V. Preferably, valve V is comprised of a spherical plug 98 which seats with aperture 97, but any other suitable aperture-sealing structure could be employed, for example, a disc-type plug arrangement. In any event, a plug retainer 100 is rigidly fixed within recess 102 of valve damping piston $P_{vd}$ so as to retain the plug (which in this case, is spherical plug 98) in position relative to aperture 97. Plug retainer 100 includes apertures 104 to permit oil to flow into the lash adjustment chamber $C_{la}$ from pressure chamber $C_p$ via aperture 97 of valve damping piston $P_{vd}$. Spherical plug 98 is biased into a seated position with respect to aperture 97 (so as to close the same) by means of a compression spring 106 (see FIGS. 5–7) acting between the plug and plug retainer 98, 100, respectively.

Figure 4:
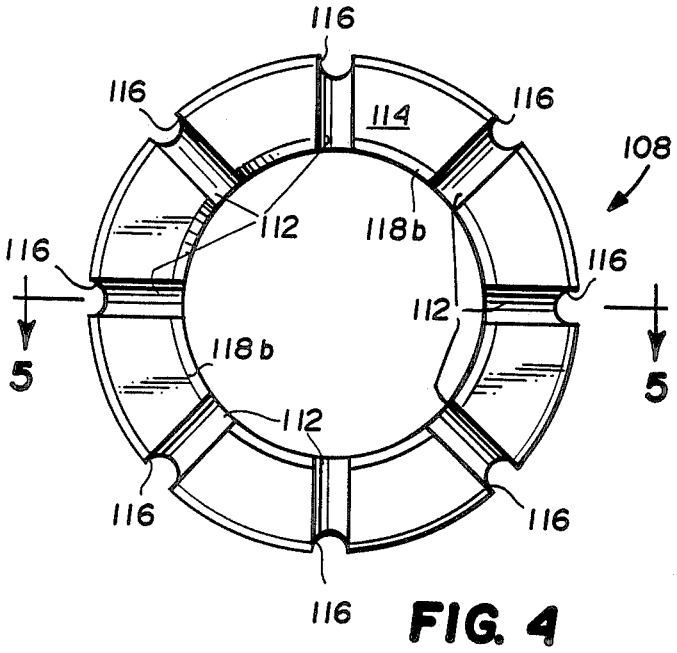
FIG. 4 is a bottom plan view of a fluid bypass ring employed within the lifter assembly of this invention.

An annular bypass ring 108 is immovably press fitted into recess 110 of shoulder 42. Bypass ring 108 is seen more clearly in accompanying FIGS. 4 and 5 as including plural, radially extending channels 112 in its bottom surface 114, each of which terminates in an end portion 116 to thereby provide a continuous passageway which establishes fluid communication between the pressure chamber $C_p$ and the annular damper chamber $C_d$ (see FIGS. 6–8). Annular upper and lower chamfered interior edges **118*a*, 118*b*, respectively, are provided so as to minimize wear on those structures which in operation move within ring 108 (e.g. stem 89 of valve damping piston $P_{vd}$) and to provide greater ease of assembly. The upper surface 120 of bypass ring 108 is, in turn, co-planar with the ledge 122 of shoulder 42 so that upper surface/ledge 120/122 establish, collectively with lower flange 80 of retaining sleeve 76, a mounting space 124 (see FIGS. 6–8) in which annular check ring 126 is movably disposed. Check ring 126 is thus capable of movements relative to end portions 116 so as to open and close the same and thus open and close fluid communication via channels 112 between pressure and damper chambers $C_p$, $C_d$, respectively Axial slots 90*b* of depending stem 90 of damping piston $P_{vd}$ thereby establish a primary fluid passageway between pressure and damper chambers $C_p$, $C_d$, respectively, while radially extending channels/end portions 112/116 of bypass ring 108** establish a secondary passageway between pressure and damper chambers $C_p$, $C_d$, respectively.

Compression springs 130, 132 (not shown in FIG. 2, but see FIGS. 5–7) are respectively positioned and act between cam follower/valve damping pistons $P_{cf}/P_{vd}$ and valve damping/lash adjusting pistons $P_{vd}/P_{la}$, respectively. Spring 130 thus biases cam follower and valve damping pistons $P_{cf}$, $P_{vd}$, respectively, in a direction tending to separate the same and thus insures that cam follower surface 74 is maintained in contact with the profile of cam 18. Similarly, compression spring 132 biases valve damping and lash adjusting pistons $P_{vd}$, $P_{la}$, respectively, in a direction tending to separate the same and thus insures that the upper surface 32 of valve lash adjusting piston $P_{la}$ is maintained in contact with end 30 of rocker arm 26 (or other suitable motion-transferring structure as push rods, finger followers, or the like) to transfer displacement of surface 32 into opening and closing of valve 14.

Figure 7:
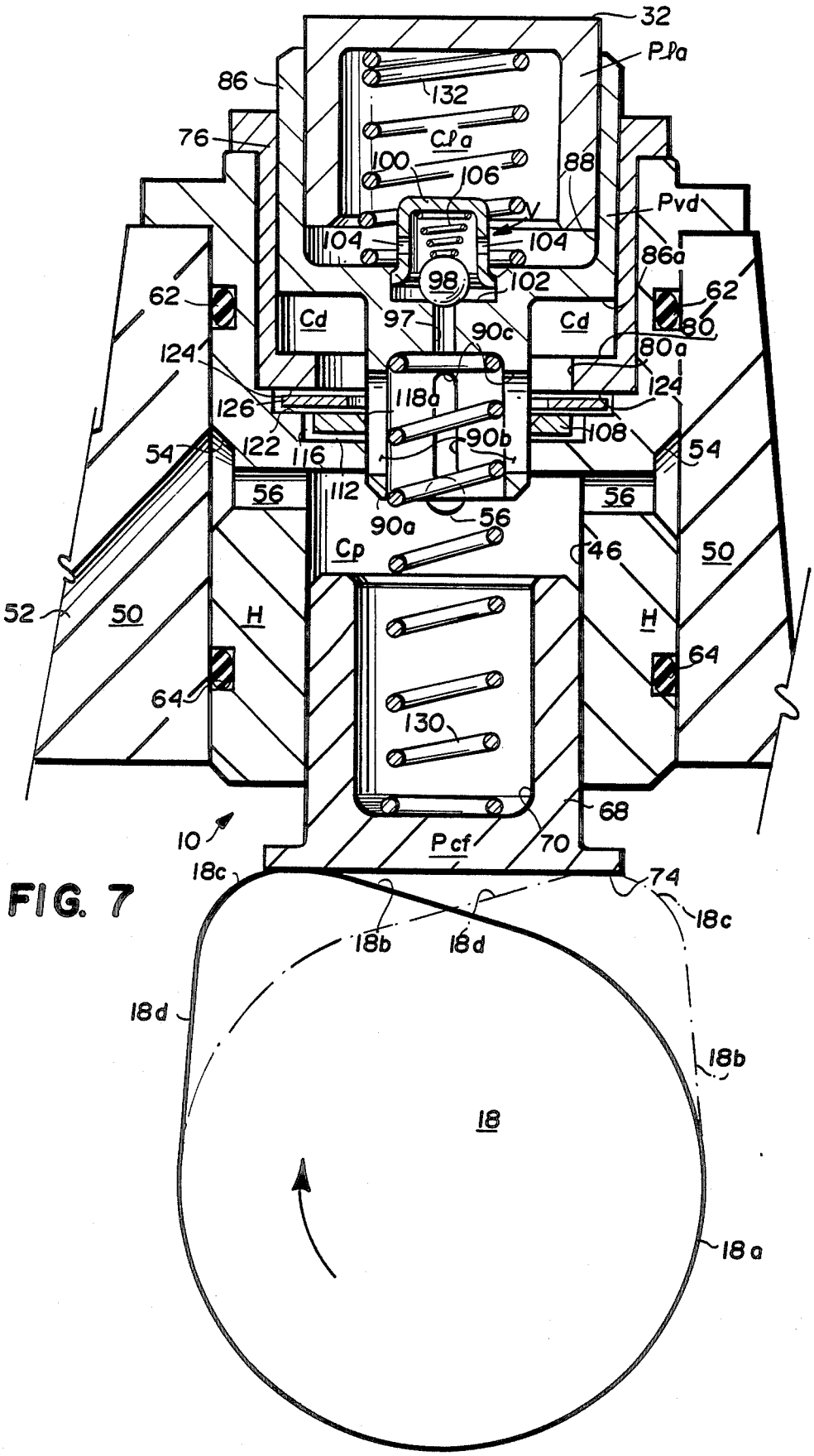
FIG. 7 is a cross-sectional elevational view of the lifter assembly of this invention shown in a predetermined position intermediate to its downstroke and upstroke positions.
Figure 8:
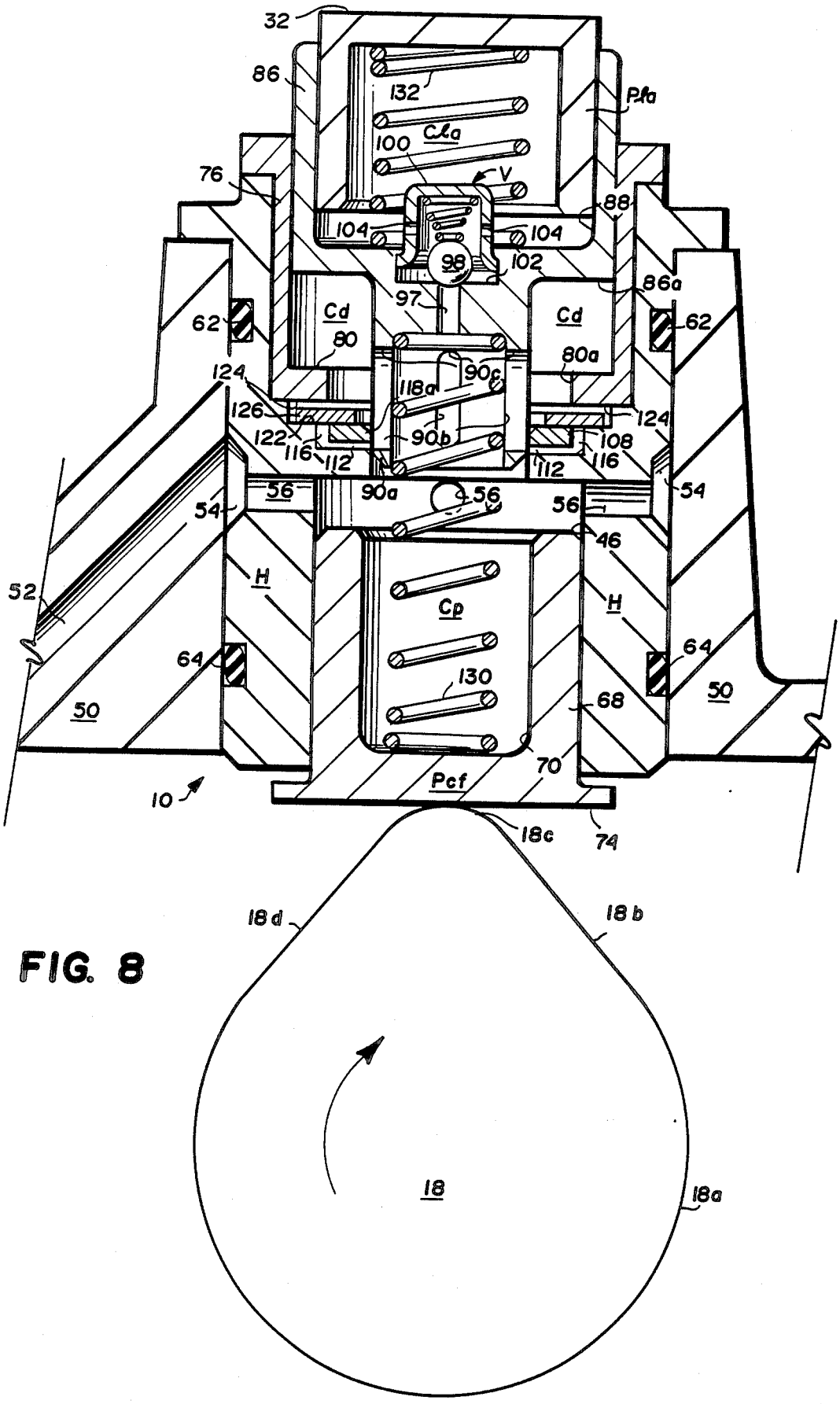
FIG. 8 is a cross-sectional elevational view of the lifter assembly of this invention shown in its extended or upstroke position.

In operation, and with particular reference being directed to accompanying FIGS. 6–8, the cycling of lifter assembly 10 begins with pistons $P_{cf}$ and $P_{vd}$ in their respective rest positions (as shown in FIG. 6)—that is, with the cam follower surface 74 of cam follower piston $P_{cf}$ resting on the base circle **18*a* of cam 18 and with shoulder surface 86*a* of valve damping piston $P_{vd}$ seated against lower flange 80 of retaining sleeve 76. Also in this position, fluid communication between pressure and damper chambers $C_p$, $C_d$, respectively, via the primary and secondary passageways (i.e. respectively, axial slots 90*b* formed in stem 90; and channels 112 formed in bypass ring 108) is closed—the former being closed by virtue of edges 90*c* of slots 90*b* being below the chamfered edge 118*a* of bypass ring 108, while the latter is closed by means of check ring 126 being seated against ledge/upper surface 122/120**.

As cam 18 rotates, cam follower surface 74 of cam follower piston $P_{cf}$ first encounters the cam's opening ramp **18*b* which thus beings to displace cam follower piston $P_{cf}$ upwardly (as viewed in FIGS. 6–8) within sub-bore 46. This phase of the cycle for lifter assembly 10 is shown specifically in FIG. 7 whereby a solid hydraulic link has been established between cam follower and valve damping pistons $P_{cf}$, $P_{vd}$, respectively. As previously mentioned, the hydraulic control system CS (see FIG. 1) of the type disclosed in the Wakeman '306 patent may be employed so as to allow cam follower piston $P_{cf}$ to collapse relative to valve damping piston $P_{vd}$ until the ECU (not shown) determines that it is the correct time to start opening engine valve 14. In this case, oil displaced due to the collapse of cam follower piston $P_{cf}$ relative to valve damping piston $P_{vd}$ exits through housing H via entrance/exit ports 56, annular oil channel 54, and oil port 52. Thus, when the ECU determines that it is the correct time to begin opening of valve 14, the hydraulic control system CS will stop the flow of oil out of the pressure chamber $P_{cf}$ by closing oil port 52, thereby creating a solid hydraulic link inside the lifter assembly 10 between cam follower and valve damping pistons $P_{cf}$, $P_{vd}$, respectively. Any subsequent upward displacement of cam follower piston $P_{cf}$ is thereby transferred via the solid hydraulic link to valve damping piston $P_{vd}$ causing the latter to be upwardly displaced within cylindrical cavity 78 of retaining sleeve 76** concurrently with the former.

Accompanying FIG. 7 shows the lifter assembly 10 in a state whereby the solid hydraulic link previously described has already been established. Thus, upward displacement of cam follower pistons $P_{cf}$ due to surface 74 thereof contacting ramp **18*b* of cam 18 is shown in FIG. 7 as being transferred to valve damping piston $P_{vd}$ so that the latter is likewise moved upwardly within cylindrical cavity 78 of the retaining sleeve 76. This upward movement of valve damping piston $P_{vd}$, in turn, increases the volume of annular damper chamber $C_d$ which fills with oil via the primary and secondary passageways—that is, oil flows from pressure chamber $P_{cf}$ through axial slots 90*b* (the primary passageway) directly into damper chamber $C_d$; and from pressure chamber $P_{cf}$ through axial slots 90*b*/channels 112 of bypass ring 108 (the secondary passageway) thereby unseating or moving check ring 126 so that the oil flows around check ring 126 in mounting space 124** and then into damper chamber $C_d$.

During an upstroke displacement of valve damping piston $P_{vd}$, the valve lash adjusting piston $P_{la}$ is displaced concurrently therewith due to a solid hydraulic link being maintained between the two pistons $P_{vd}$ and $P_{la}$ via oil-filled valve lash adjustment chamber $C_{la}$. It should be noted here that the surface area of cam follower surface 74 is greater than the surface area of upper surface 32 of valve lash adjusting piston $P_{la}$, so that the displacement force exerted upon cam follower piston $P_{cf}$ is translated into an oil pressure within pressure chamber $C_p$ which is less than the pressure of the oil within valve lash adjustment chamber $C_{la}$ when surface 74 contacts cam 18 at locations other than the cam's base circle 18a. This differential pressure existing between the oil within pressure and valve lash adjustment chambers $P_{cf}$, $C_{la}$, respectively, (with the higher pressure being within the valve lash adjustment chamber $C_{la}$), thereby maintains the spherical plug 98 in its seated position with respect to coaxial aperture 97 in valve damping piston $P_{vd}$. Thus, during upstrokes and downstrokes of valve damping/lash adjustment pistons $P_{vd}/P_{la}$, a solid hydraulic link is always maintained therebetween via oil-filled lash adjustment chamber $C_{la}$. Moreover, this differential pressure prevents the lash adjusting piston $P_{la}$ from being "pumped up" (i.e. displaced independently of valve damping piston $P_{vd}$ during upstrokes and downstrokes thereof) which would deleteriously "freeze" the opening and closing of engine valve 14. However, when the cam follower surface 74 is in contact with the base circle of cam 18, it is believed that substantially equal pressures will exist within pressure chamber $C_p$ and lash adjustment chamber $C_{la}$ (since substantially no force is being transmitted to piston $P_{cf}$ via cam 18). At this time, the biasing force provided by spring 132 is of sufficient magnitude to cause valve lash adjusting piston $P_{la}$ to be displaced upwardly relative to valve damping pistons $P_{vd}$ (if a clearance exists between end 30 of rocker arm 26 and surface 32) so as to automatically adjust the lash therebetween—that is, maintain zero lash between end 30 of rocker arm 26 and surface 32. Such upward displacement of piston $P_{la}$ will, in turn, unseat spherical plug 98 thereby drawing an amount of oil from chamber $C_p$ into chamber $C_{la}$ so as to reestablish the solid hydraulic link between pistons $P_{vd}$ and $P_{la}$. In this manner, valve lash is automatically hydraulically adjusted.

It should also be noted that at the moment the hydraulic link is established between pistons $P_{cf}$ and $P_{vd}$ so as to displace the latter concurrently with the former, oil will immediately be drawing into damper chamber $C_d$ via the secondary passageway of channels 112 of bypass ring 108 (the check ring 126 being responsively unseated by virture of such oil flow) even though direct fluid communication between chambers $C_p$ and $C_d$ has not yet been established via the primary passageway of slots **90*b***. This function is important since it prevents piston $P_{vd}$ from being damped on its upstroke thereby also insuring that a lesser pressure exists in chamber $C_p$ as compared to chamber $C_{la}$ to thus preclude valve lash adjusting piston $P_{la}$ from being deleteriously "pumped up" as was briefly described above.

At top dead center of lobe **18*c*, displacement of cam follower piston $P_{cf}$ is at its maximum extent and thus valve damping and lash adjusting pistons $P_{vd}$, $P_{la}$, respectively, are in their maximum extended positions. This extension of pistons (as is shown in FIG. 8) $P_{vd}$ and $P_{la}$ is transferred to valve 14 via rocker arm 26 as has been previously described so as to open the same. Upon continued rotation of cam 18, cam follower surface 74 then encounters cam closing ramp 18*d* and, due to the bias assist provided by spring 130**, (and the solid hydraulic link established between pressure and lash adjustment chambers $C_p$, $C_{la}$, respectively), valve damping piston $P_{vd}$ and lash adjusting piston $P_{la}$ concurrently downstroke therewith to the position shown in FIG. 7.

As the valve damping/lash adjusting pistons $P_{vd}/P_{la}$ begin their downstroke (i.e. from that position shown in FIG. 8 towards that position shown in FIG. 7), the fluid flow from damper chamber $C_d$ into pressure chamber $C_p$ responsively causes check ring 126 to be seated against ledge/surface 122/120 thereby closing the secondary passageway (i.e. channels 112 of bypass ring 108). However, the primary passageway established by axial slots **90*b* is still open for fluid communication between valve damper chamber $C_d$ and pressure chamber $C_p$ so that fluid continues to flow from the latter into the former during further downstroke movement of pistons $P_{vd}$ and $P_{la}$. When the upper edges 90*c* of axial slots 90*b* are positioned below (as viewed in FIGS. 6–8) the chamfered edge 118*a* of bypass ring 108**, the primary passageway will thus be closed and this creates a beneficial increased pressure buildup within damper chamber $C_d$ for that oil which remains therein.

It is to be understood that closure of channels 112 and axial slots **90*c* is not a perfect seal and thus, further downstroke movement of valve damping piston $P_{vd}$ is permitted under the bias force of spring 130 due to oil leakage (albeit at greatly reduced flow rate) between check ring 126 and ledge/surface 122/120, and/or between bypass ring 108 and stem portion 90 of valve damping piston $P_{vd}$, and/or between piston $P_{vd}$ and retaining sleeve 76. Thus, that position during the downstroke movement of valve damping piston $P_{vd}$ may be predetermined by virtue of the relative alignment of upper edge 90*c* of slots 90*b* and ledge/surface 122/120 so that during further downstroke movement of valve damping piston $P_{vd}$, the increased pressure of oil remaining in damper chamber $C_d$ causes such further movement to be "damped" (i.e. cushioned) thereby, in turn, responsively cushioning closure of valve 14** to its seat.

As cam 18 continues to rotate, cam follower surface 74 will again encounter the cam's base circle **18*a* and, if employing the system described in the Wakeman '306 patent, pressure pulses from the fluid circuit will assist in keeping cam follower piston $P_{cf}$, and thus cam follower surface 74, engaged therewith so as to reestablish the positions of the component parts of lifter assembly 12 as shown in FIG. 6. Alternatively, the force of spring 130 can be preselected so as to assist in returning surface 74 of cam follower piston $P_{cf}$ into engagement with the base circle 18*a* of cam 18**.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a hydraulic engine valve lifter of the type including a pair of pistons defining therebetween a pressure chamber, the improvement comprising a lash adjusting piston establishing a lash adjustment chamber with respect to at least one of said pair of pistons, and one-way valve means for permitting fluid to flow from said pressure chamber into said lash adjustment chamber when excess valve lash is present whereby such excess valve lash is adjusted, and damping control means for preventing motion damping of said at least one piston during an upstroke thereof while yet damping motion of said at least one piston at a predetermined position during a downstroke thereof, said damping control means including a valve damper chamber, primary and secondary passageways between said pressure and damper chambers, a secondary passageway closing means movable between (i) an open position with respect to said secondary passageway to allow fluid to flow into said damper chamber during said upstroke of said at least one piston whereby motion damping thereof is prevented, and (ii) a closed position to prevent fluid from flowing from said damper chamber into said pressure chamber during a downstroke of said at least one piston, and primary passageway closing means for closing said primary passageway at said predetermined position during said downstroke of said at least one piston, said primary passageway closing means closing said primary passageway subsequent to closure of said secondary passageway by said secondary passageway closing means, whereby motion damping of said at least one piston occurs.

2. In a hydraulic engine valve lifter of the type including a pair of pistons defining therebetween a pressure chamber, the improvement comprising a lash adjusting piston establishing a lash adjustment chamber with respect to at least one of said pair of pistons, and one-way valve means for permitting fluid to flow from said pressure chamber into said lash adjustment chamber when excess valve lash is present whereby such excess valve lash is adjusted, wherein a valve damping piston constitutes said at least one piston, and wherein said improved engine valve lifter further includes:

a valve damping chamber annularly surrounding said valve damping piston, primary and secondary fluid passageways establishing fluid communication between said pressure chamber and said valve damping chamber, secondary passageway closing means movable with respect to said defined secondary passageway between a separated position during an upstroke of said valve damping piston and a seated position during a downstroke of said valve damping piston so as to open and close, respectively, communication between said pressure and damper chambers via said defined secondary fluid passageway, and primary passageway closing means for establishing a predetermined position during a downstroke of said pair of pistons by closing fluid communication between said pressure and valve damping chambers via said primary fluid passageway, whereby further downstroke motion of said pair of pistons beyond said predetermined position is damped

3. Engine valve lifter assembly comprising:

a housing having an elongate bore;

a cam follower piston adapted to following a rotatable profiled cam and slidably received within a lower portion of said housing bore for reciprocal movements therewithin in response to following the profile of the cam;

a lash adjusting piston coaxially positioned in said housing bore with respect to said cam follower piston;

a valve damping piston slidably received within an upper portion of said housing bore for reciprocal movements therewithin between rest and extended positions and coaxially disposed between said cam follower and said lash adjusting pistons so that lash adjustment chamber is defined between said valve damping piston and said lash adjusting piston and a pressure chamber is defined between said valve damping piston and said cam follower piston;

an annular damper chamber defined between an exterior portion of said valve damping piston and a corresponding portion of said housing bore, said damper chamber increasing and decreasing in volume during an upstroke and a downstroke, respectively, of said valve damping piston between its said rest and extended positions;

means for admitting a working fluid into said pressure chamber, said working fluid admitted into said pressure chamber hydraulically transferring reciprocal movements of said cam follower piston to said valve damping piston so as to cause said valve damping piston to be reciprocally displaced between its said rest and extended positions;

means establishing fluid communication between said pressure and lash adjustment chambers for allowing an amount of said working fluid to flow from said pressure chamber into said lash adjustment chamber so as to adjustably displace said lash adjusting piston relative to said valve damping piston, whereby valve lash is adjusted, said amount of working fluid in said lash adjusting chamber also transferring reciprocal displacements of said valve damping piston to said lash adjusting piston, wherein said lash adjusting piston is concurrently displaced with said valve damping piston during the latter's reciprocal movements between said rest and extended positions, whereby engine valve opening and closing is controlled;

valve damping control means for (a) opening fluid communication between said pressure chamber and said damper chamber so as to allow said working fluid to be admitted into said damper chamber from said pressure chamber in response to an upstroke of said valve damping piston, and (b) closing fluid communication between said pressure chamber and said damper chamber at a predetermined downstroke position of said valve damping piston prior to said valve damping piston reaching its said rest position, whereby further movement of said valve damping piston from its said predetermined position to its said rest position is damped, wherein said valve damping control means further includes, (i) at least one elongate slot having an upper edge defined by said valve damping piston;

(ii) an annular bypass ring rigidly secured within said housing and surrounding said valve damping piston, said bypass ring having plural radially extending channels which establish fluid communication between said pressure chamber and said damper chamber via said at least one slot of said damping piston; and (iii) a check ring disposed within a portion of said damper chamber and movable therewithin between (a) an unseated position, wherein said check ring is unseated relative to said bypass ring so as to open said plural channels and thus permit said working fluid to be freely transferred via said plural channels between said pressure and damper chambers, and (b) a seated position, wherein said check ring is seated with said bypass ring so as to close said plural channels and thus prevent fluid from being freely transferred between said pressure and damper chambers.

4. Engine valve lifter assembly as in claim 3, wherein the relative locations of said upper edge of said at least one slot and an upper surface of said bypass ring establish said predetermined position.

5. Engine control valve lifter assembly as in claim 4, wherein plural said slots are defined by said valve damping piston, each having an upper edge such that the location of each said upper edge thereof relative to said upper surface of said bypass ring establishes said predetermined position.

6. Hydraulic engine valve lifter assembly comprising:

a housing having an inner bore and shoulder means for dividing said inner bore into first and second sub-bores;

a cam follower piston slidably received in said first sub-bore for reciprocal movements therewithin and adapted to following a profile of a rotatable cam;

a valve damping piston slidably received in said second sub-bore for reciprocal movements therein between rest and extended positions and adapted to transferring said reciprocal movements of said cam follower piston to an engine valve so as to open and close same;

a pressure chamber defined between said cam follower and said valve damping pistons, wherein said housing includes means for introducing a working fluid into said pressure chamber;

an annular damper chamber defined by said housing, said divider means and said valve damping piston; and fluid control valving means for (i) establishing communication between said pressure and damper chambers during an upstroke of said cam follower piston to allow said working fluid to flow into said damper chamber from said pressure chamber thereby hydraulically causing said valve damping piston to upstroke from its said rest position to its said extended position, and (ii) closing communication between said pressure and damper chambers at a predetermined location of said valve damping piston during a downstroke thereof from its said extended position to its said rest position thereby to allow that portion of said working fluid remaining in said damper chamber to damp the return of said valve damping chamber to damp the return of said valve damping piston from its said predetermined position to its said rest position, said fluid control valving means including;

(a) means defining a primary fluid passageway from said pressure chamber to said damper chamber;

(b) means defining a secondary fluid passageway from said pressure chamber to said damper chamber;

(c) secondary passageway closing means movable with respect to said defined secondary fluid passageway between a separated position during said upstroke of said valve damping piston and a seated position during a downstroke of said valve damping piston so as to open and close, respectively, communication between said pressure and damper chambers via said defined secondary fluid passageway; and (d) primary passageway closing means for establishing said predetermined downstroke position of said valve damping piston by closing communication between said pressure and damper chambers via said primary fluid passageway, wherein communication between said pressure and damper chambers via both said primary and secondary fluid passageways are closed substantially at said predetermined downstroke position of said valve damping piston to damp further movement thereof to its said rest position.

7. Hydraulic engine valve lifter assembly as in claim 6, wherein a portion of said valve damping piston extends into said firstsub-bore, and wherein said means defining said primary fluid passageway includes an elongate slot defined in said portion of said valve damping piston, said slot being of sufficient axial length so as to establish fluid communication between said pressure and damper chambers when said valve damping piston is moved from its said rest position into its said extended position.

8. Hydraulic engine valve lifter assembly as in claim 7, wherein said means defining said secondary fluid passageway includes a fluid bypass ring rigidly seated with respect to said shoulder means and annularly surrounding said portion of said valve damping piston, said bypass ring defining plural radially extending channels having one end opening into said pressure chamber and an opposite end opening into said damper chamber, wherein said channels constitute said defined secondary fluid passageway, and wherein said secondary passageway closing means substantially closes said opposite ends of said bypass ring channels when in its said seated position.

9. Hydraulic engine valve lifter assembly as in claim 8, wherein said primary passageway closing means is provided by the relative positioning of an upper edge of said slot and an upper surface of said bypass ring so that when said upper edge and said upper surface meet during a downstroke of said valve damping piston from its said extended position to its said rest position, said predetermined position is established and said communication of said pressure and damper chambers via said primary passageway defined by said slot is substantially closed.

10. Hydraulic engine valve lifter assembly as in claim 8, wherein said secondary fluid passageway closing means includes a check ring annularly surrounding said portion of said valve damping piston and moveable between said separated and seated positions with respect to said opposite ends of said bypass ring channels.

11. Hydraulic engine valve lifter assembly as in claim 10, wherein said secondary fluid passageway closing means includes retaining means for positionally retaining said check ring relative to said bypass ring yet permitting said check ring to move between said separated and seated positions.

12. Hydraulic engine valve lifter assembly as in claim 11, wherein said retaining means includes a retaining flange which defines, with said bypass ring, an annular valving chamber therebetween, said check ring being positioned for movements within said valving chamber between said separated and seated positions.

13. Hydraulic engine valve lifter assembly as in claim 6, further comprising spring biasing means for urging said cam follower and valve damping pistons in a direction tending to separate the same.

14. Hydraulic engine valve lifter assembly as in claim 6, further comprising a lash adjusting piston coaxially positioned in said housing bore so that said valve damping piston is disposed between said lash adjusting and cam follower pistons.

15. Hydraulic engine valve lifter assembly as in claim 14, further comprising a lash adjustment chamber defined between said lash adjusting and said valve damping pistons, and means establishing fluid communication between said pressure and lash adjustment chambers for allowing an amount of said working fluid to flow from said pressure chamber into said lash adjustment chamber so as to adjustably displace said lash adjusting piston relative to said valve damping piston, whereby valve lash is adjusted.

16. Hydraulic engine valve lifter assembly as in claim 15, wherein said means establishing fluid communication between said pressure and lash adjustment chambers includes an aperture defined by said valve damping piston so as to establish fluid communication between said pressure and lash adjustment chambers, and one-way valve means for normally closing said aperture yet allowing opening of said aperture to permit said amount of said working fluid to flow into said lash adjustment chamber thereby adjustably displacing said lash adjusting piston.

17. Hydraulic engine valve lifter assembly as in claim 16, wherein said one-way valve means includes a spherical member which normally closes said aperture.

18. Hydraulic engine valve lifter assembly as in claim 13, wherein said valve damping piston includes a cylindrical extension, said lash adjusting piston being slidably received within said cylindrical extension such that said valve damping and said lash adjusting pistons defining an enclosed lash adjustment chamber therebetween.

19. Hydraulic engine valve lifter assembly as in claim 18, further comprising means establishing fluid communication between said pressure and lash adjustment chambers for allowing an amount of said working fluid to flow from said pressure chamber into said lash adjustment chamber so as to adjustably displace said lash adjusting piston relative to said valve damping piston, whereby valve lash is adjusted.

20. An engine valve lifter assembly as in claim 19, wherein said means establishing fluid communication between said pressure and lash adjustment chambers includes an aperture defined by said valve damping piston so as to establish fluid communication between said pressure and lash adjustment chambers, and one-way valve means for normally closing said aperture yet allowing opening of said aperture to permit said amount of said working fluid to flow into said lash adjustment chamber thereby adjustably displacing said lash adjusting piston.

21. Hydraulic engine valve lifter assembly as in claim 20, wherein said one-way valve means includes a spherical member which normally closes said aperture.

22. Hydraulic engine valve lifter assembly as in claim 18, further comprising first and second spring biasing means disposed within said pressure and lash adjustment chambers, respectively, said first and second spring biasing means for respectively urging said cam follower and said lash adjusting pistons in a direction tending to separate same from said valve damping piston.

23. In a hydraulic valve lifter of the type including a pair of pistons defining therebetween a pressure chamber, the improvement comprising:

means defining a damping chamber in operative association with one of said pair of pistons;

annular fluid bypass means which defines at least one radially extending channel in fluid communication with said pressure chamber;

means establishing an annular valving chamber disposed between said bypass member and said damping chamber such that said valving chamber fluid-connects said at least one channel and said damping chamber thereby providing fluid communication between said pressure and damping chambers; and check ring means mounted within said annular valving chamber for movements therewithin between unseated and seated positions with respect to said annular fluid bypass means which respectively allow and prevent fluid from flowing between said pressure and damping chambers.

24. In a hydraulic valve lifter as in claim 23, the improvement further comprising a lash adjusting piston establishing a lash adjustment chamber with respect to one of said pair of pistons.

25. In a hydraulic valve lifter as in claim 24, the improvement further comprising one way valve means which allow fluid to flow from said pressure chamber and into said lash adjustment chamber, whereby valve lash is adjusted.

26. In an internal combustion engine of the type having a rotatable profiled cam, an engine valve reciprocally movable between open and closed positions, and engine valve control means for following the profile of said cam during rotation thereof and for controllably translating same into said reciprocal movements of said engine valve between its said open and closed positions, the improvement wherein said engine valve control means comprises a hydraulic valve lifter assembly including:

a housing having an inner bore and shoulder means for dividing said inner bore into first and second sub-bores;

a cam follower piston slidably received in said first sub-bore for reciprocal movements therein and for following the profile of said cam during rotation thereof;

a valve damping piston slidably received in said second sub-bore for reciprocal movements therein between rest and extended positions and for transferring said reciprocal movements of cam follower piston to said engine valve so as to move same between said open and closed positions;

a pressure chamber defined between said cam follower and valve damping pistons, wherein said housing includes means for introducing a working fluid into said pressure chamber;

an annular damper chamber defined by said housing, said divider means and said valve damping piston; and fluid control valving means for (i) establishing communication between said pressure and damper chambers during an upstroke of said cam follower piston to allow said working fluid to flow into said damper chamber from said pressure chamber thereby hydraulically causing said valve damping piston to upstroke from its said rest position to its said extended position, and (ii) closing communication between said pressure and damper chambers at a predetermined position to said valve damping piston during a downstroke thereof from its said extended position to its said rest position thereby to allow that portion of said working fluid remaining in said damper chamber to damp the return of said control piston from said predetermined position to its said rest position, said fluid control valving means including;

(a) means defining a primary fluid passageway between said pressure chamber and said damper chamber;

(b) means defining a secondary fluid passageway between said pressure chamber and said damper chamber;

(c) secondary passageway closing means movable with respect to said secondary fluid passageway between a separated position during said upstroke of said valve damping piston and a seated position during a downstroke of said valve damping piston so as to open and close, respectively, communication between said pressure and damper chambers via said defined secondary fluid passageway; and (d) primary passageway closing means for establishing said predetermined downstroke position of said valve damping piston by closing communication between said pressure and damper chambers via said primary fluid passageway, wherein communication between said pressure and damper chambers via both said primary and secondary fluid passageways are closed substantially at said predetermined downstroke position of said valve damping piston to damp further movement thereof to its said rest position.

27. In an engine of the type as recited in claim 26, the improvement further comprising a hydraulic engine valve lifter assembly wherein a portion of said valve damping piston extends into said first sub-bore and wherein said means defining said primary fluid passageway includes an elongate slot defined in said portion of said valve damping piston, said slot being of sufficient axial length so as to establish fluid communication between said pressure and damper chambers when said valve damping piston is moved from its said rest position into its said extended position.

28. In an engine of the type as recited in claim 27, the improvement further comprising a hydraulic engine valve lifter assembly wherein said means defining said second fluid passageway includes a fluid bypass ring rigidly seated with respect to said shoulder means and annularly surrounding said portion of said valve damping piston, said bypass ring defining plural radially extending channels having one end opening into said pressure chamber and an opposite end opening into said damper chamber, wherein said channels constitute said defined secondary fluid passageway, and wherein said secondary passageway closing means substantially closes said opposite ends of said bypass ring channels when in its said seated position.

29. In an engine of the type recited in claim 28, the improvement further comprising a hydraulic engine valve lifter assembly wherein said primary passageway closing means is provided by relative positioning of an upper edge of said slot and an upper surface of said bypass ring so that when said upper edge and said upper surface meet during a downstroke of said valve damping piston from its said extended position to its said rest position, said predetermined position is established and said communication of said primary passageway defined by said slot is closed.

30. Engine valve lifter assembly comprising:

a housing having an elongate bore;

a cam follower piston adapted to following a rotatable profiled cam and slidably received within a lower portion of said housing bore for reciprocal movements therewithin in response to following the profile of the cam;

a lash adjusting piston coaxially positioned in said housing bore with respect to said cam follower piston;

a valve damping piston slidably received within an upper portion of said housing bore for reciprocal movements therewithin between rest and extended positions and coaxially disposed between said cam follower and said lash adjusting pistons so that a lash adjustment chamber is defined between said valve damping piston and said lash adjusting piston and a pressure chamber is defined between said valve damping piston and said cam follower piston;

an annular damper chamber defined between an exterior portion of said valve damping piston and a corresponding portion of said housing bore, said damper chamber increasing and decreasing in volume during an upstroke and a downstroke, respectively, of said valve damping piston between its said rest and extended positions;

means for admitting a working fluid into said pressure chamber, said working fluid admitted into said pressure chamber hydraulically transferring reciprocal movements of said cam follower piston to said valve damping piston so as to cause said valve damping piston to be reciprocally displaced between its said rest and extended positions;

means establishing fluid communication between said pressure and lash adjustment chambers for allowing an amount of said working fluid to flow from said pressure chamber into said lash adjustment chamber so as to adjustably displace said lash adjusting piston relative to said valve damping piston, whereby valve lash is adjusted, said amount of working fluid in said lash adjusting chamber also transferring reciprocal displacements of said valve damping piston to said lash adjusting piston, wherein said lash adjusting piston is concurrently displaced with said valve damping piston during the latter's reciprocal movements between said rest and extended positions, whereby engine valve opening and closing is controlled;

valve damping control means for (a) opening fluid communication between said pressure chamber and said damper chamber so as to allow said working fluid to be admitted into said damper chamber from said pressure chamber in response to an upstroke of said valve damping piston, and (b) closing fluid communication between said pressure chamber and said damper chamber at a predetermined downstroke position of said valve damping piston prior to said valve damping piston reaching its said rest position, whereby further movement of said valve damping piston from its said predetermined position of its said rest position, whereby further movement of said valve damping piston from its said predetermined position to its said rest position is damped, and wherein said valve damping control means includes, (i) means defining a primary fluid passageway from said pressure chamber to said damper chamber;

(ii) means defining a secondary fluid passageway from said pressure chamber to said damper chamber;

(iii) secondary passageway closing means movable with respect to said defined secondary fluid passageway between a separated position during said upstroke of said valve damping piston and a seated position so as to open and close, respectively, communication between said pressure and damper chambers via said secondary passageway; and (iv) primary passageway closing means for establishing said predetermined downstroke position of said valve damping piston by closing communication between said pressure and damper chambers via said primary fluid passageway, wherein communication between said pressure and damper chambers via both said primary and secondary fluid passageways are closed substantially at said predetermined downstroke position of said valve damping piston to damp further movement thereof to its said rest position.

31. Hydraulic engine valve lifter assembly as in claim 30 wherein a portion of said valve damping piston extends into said lower portion of said housing bore and wherein said means defining said primary fluid passageway includes an elongate slot defined in said portion of said valve damping piston, said slot being of sufficient axial length so as to establish fluid communication between said pressure and damper chambers when said valve damping piston is moved from its said rest position into its said extended position.

32. Engine valve lifter assembly as in claim 31, wherein said means defining said secondary fluid passageway includes a fluid bypass ring rigidly seated with respect to said housing and annularly surrounding said portion of said valve damping piston, said bypass ring defining plural radially extending channels having one end opening into said pressure chamber and an opposite end opening into said damper chamber, wherein said channels constitute said secondary fluid passageway, and wherein said secondary passageway closing means closes said opposite ends of said bypass ring channels when in its said seated position.

33. Engine valve lifter assembly as in claim 32, wherein said primary passageway closing means is provided by the relative positioning of an upper edge of said slot and an upper surface of said bypass ring so that when said upper edge and said upper surface meet during a downstroke of said valve damping piston from its said extended position to its said rest position, said predetermined position is established and said communication of said pressure and damper chambers via said primary passageway defined by said slot is closed.

34. Engine valve lifter assembly as in claim 32, wherein said secondary fluid passageway closing means includes a check ring annularly surrounding said portion of said valve damping piston moveable between said separated and seated positions with respect to said opposite ends of said bypass ring channels.

35. Engine valve lifter assembly as in claim 34, wherein said secondary fluid passageway closing means includes retaining means for positionally retaining said check ring relative to said bypass ring yet permitting said check ring to move between its said separated and seated positions.

36. Engine valve lifter assembly as in claim 35, wherein said retaining means includes a retaining flange which defines, with said bypass ring, an annular valving subchamber of said damper chamber therebetween, said check ring being positioned for movements within said valving subchamber between said separated and seated positions.

37. Engine valve lifter assembly as in claim 30, wherein said valve damping piston includes a cylindrical extension, said lash adjusting piston being slidably received within said cylindrical extension such that said valve damping and said lash adjusting pistons define an enclosed said lash adjustment chamber therebetween.

38. Engine valve lifter assembly as in claim 37, wherein said means establishing fluid communication between said pressure and lash adjustment chambers includes an aperture defined by said valve damping piston so as to establish fluid communication between said pressure and lash adjustment chambers, and one-way valve means for normally closing said aperture yet allowing opening of said aperture to permit said amount of said working fluid to flow into said lash adjustment chamber thereby adjustably displacing said lash adjusting piston.

39. Engine valve lifter assembly as in claim 38, wherein said one-way valve means includes a spherical member which normally closes said aperture.

* * * * *